US010127840B1

(12) United States Patent
Fridman

(10) Patent No.: US 10,127,840 B1
(45) Date of Patent: Nov. 13, 2018

(54) PATIENT IDENTIFICATION BAND WITH A TAB COVER

(71) Applicant: Vladimir Fridman, Brooklyn, ND (US)

(72) Inventor: Vladimir Fridman, Brooklyn, ND (US)

( * ) Notice: Subject to any disclaimer, the term of this patent is extended or adjusted under 35 U.S.C. 154(b) by 0 days.

(21) Appl. No.: 15/593,229

(22) Filed: May 11, 2017

(51) Int. Cl.
*G09F 3/00* (2006.01)

(52) U.S. Cl.
CPC ..... *G09F 3/005* (2013.01)

(58) Field of Classification Search
CPC ..... G09F 3/005
See application file for complete search history.

(56) References Cited

U.S. PATENT DOCUMENTS 3,214,852 A * 11/1965 Ford ..... G09F 3/005 40/586
3,279,107 A * 10/1966 Baumgartner ..... G09F 3/005 156/250
3,715,570 A * 2/1973 Weichselbaum ..... A61B 5/117 235/449
5,477,633 A * 12/1995 Leinberger ..... G09F 3/005 2/16
5,581,924 A * 12/1996 Peterson ..... G09F 3/005 40/633
5,704,067 A * 1/1998 Brady ..... A41D 20/00 116/222
6,092,321 A * 7/2000 Cheng ..... G09F 3/005 40/633
2003/0074821 A1* 4/2003 Goodin ..... G09F 3/005 40/633
2004/0237367 A1* 12/2004 Ali ..... G09F 3/005 40/633
2005/0040226 A1* 2/2005 Al-Sheikh ..... G07B 15/00 235/380
2012/0074184 A1* 3/2012 Morgan ..... A45F 5/00 224/222

* cited by examiner

*Primary Examiner* — Gary C Hoge
(74) *Attorney, Agent, or Firm* — Furr Law Firm; John D. Gugliotta

(57) ABSTRACT

A patient identification unit is provided including a conformable sleeve configured to be worn by a patient such that it extends substantially along an extremity. The sleeve includes a band information display portion, and an occluding insert that is slidably placed to cover the band information display portion. Private information of the patient is provided in the band information display portion beneath the occluding insert. Public information of the patient is provided on an outer surface of the occluding insert forming a tab information display portion. In such a configuration the patent may be able to carry a considerably larger amount of medical information in a manner that both satisfies regulatory privacy laws while allowing access by medical providers in a situation where the patient is unconscious or unable to communicate.

20 Claims, 2 Drawing Sheets

PATIENT IDENTIFICATION BAND WITH A TAB COVER

FIELD OF THE DISCLOSED TECHNOLOGY

The disclosed technology relates generally to patient care. More specifically, the disclosed technology relates to patient identification bands with a tab and a information display for storing patient identifying information while maintaining the patient's privacy.

BACKGROUND OF THE DISCLOSED TECHNOLOGY

Patients in various settings, such as hospital and clinic settings, need to be easily identifiable to medical personnel, in order to ensure that the right treatment at the right dose is being given to the right patient, at the right time, via the right route. As such, most patients carry, or wear, an identification device, such as a wrist band, a patient badge, or other suitable identification device, which has written thereon or included therein identifying patient information for the benefit of the treating medical personnel.

Typically, the identifying information stored on the identification device includes the patient's demographic information, such as the patient's name, date of birth, identification number such as a social security number of passport number. However, printing of the patient's personal information on the identification device often enables non-medical personnel and/or passersby to see such private information, resulting in loss of privacy to the patient.

Additionally, it would be advantageous to medical personnel and other caretakers of a patient to be able to easily access the patient's personal medical information and treatment information, without the risk of confusing the information with that of another patient, and without the need to access the entire medical file for the patient. As such, it would be advantageous for the identification device to additionally include the patient's personal medical information, such as indications of the patient's allergies or chronic diseases, and treatment information such as the patient's treatment preferences (e.g. a request to draw blood only from one arm), the name of the attending doctor, date of admittance, and the like. However, existing patient identification bands are narrow, and do not enable inclusion of so much information in the limited space available on the patient band.

Additionally, there exists a need to have patients health care information even when the are not in a hospital or clinic. Patients need something that is quick and easy to read outside just in case they have an emergency Accordingly, there exists the need for a patient identification device which would be able to include the patient's personal medical information, demographic information, and that maintains the patient's privacy but is still easily accessible to medical personnel and caretakers of the patient.

SUMMARY OF THE DISCLOSED TECHNOLOGY

The disclosed technology described herein addresses a need unfulfilled in the prior art by providing a patient identification band that can store the patient's personal medical information, demographic information, and treatment information, while maintaining the patient's privacy.

In accordance with some aspects of an embodiment of the teachings herein there is provided a patient band, including a band portion configured to be worn by a patient such that it extends substantially between a first joint and a second joint, the band portion including a band information display portion and a tab attached to the band portion at a first side of the band and configured to removably connect to the band portion via tab sliding slots, the tab placed to cover the band information display portion wherein private information of the patient is provided in the band information display portion and public information of the patient is provided in a tab information display portion.

In some embodiments, the band portion is configured to be worn around the patient's arm, and to extend substantially from the patient's elbow to the patient's wrist. In some embodiments, the band portion is configured to be worn around the patient's biceps and to extend substantially from the patient's elbow to the patient's armpit. In some embodiments, the band portion is configured to be worn around a portion of the patient's leg, and to extend substantially from the patient's knee to the patient's ankle.

In some embodiments, the private information includes demographic information of the patient, including at least one of the patient's name, the patient's date of birth, and the patient's identification number. In some embodiments, the private information includes treatment information of the patient, including at least one of a listing of the patient's attending physician, contact information for the attending physician, a medical record number for the patient, and information regarding the patient's special care needs.

In some embodiments, the public information includes medical information for the patient, including at least one of a listing of patient allergies, living will information, Do Not Intubate (DNI) information for the patient, and Do Not Resuscitate (DNR) information for the patient. In some embodiments, the public information also includes at least one of the patient's initials, date of insertion of a current IV, location of the current IV, identification of medical personnel who inserted the current IV, the patient's medical facility room number, and a scannable barcode associated with the patient's private information and/or medical record.

In some embodiments, at least one of the band information display portion comprises multiple information display regions, each displaying a different type of information and/or a different information item.

In some embodiments, the placing the patient band comprises placing the band portion around the patient's arm, substantially between the patient's elbow to the patient's wrist. In some embodiments, the placing the patient band comprises placing the band portion around the patient's biceps, substantially between the patient's elbow to the patient's armpit. In some embodiments, the placing the patient band comprises placing the band portion around the patient's leg, substantially between the patient's knee and the patient's ankle.

In one embodiment, the patient ban is used outside a hospital or clinic. The patients can simply wear this the patient band at home or while traveling or outside the house just in case they have an emergency as the patient ban is much more thorough and informative.

In some embodiments, the information will be stored on a pull able tab, underneath which would be the protected HIPAA information.

BRIEF DESCRIPTION OF THE DRAWINGS

Without restricting the full scope of this invention, the preferred form of this invention is illustrated in the following drawings.

Figure 1:
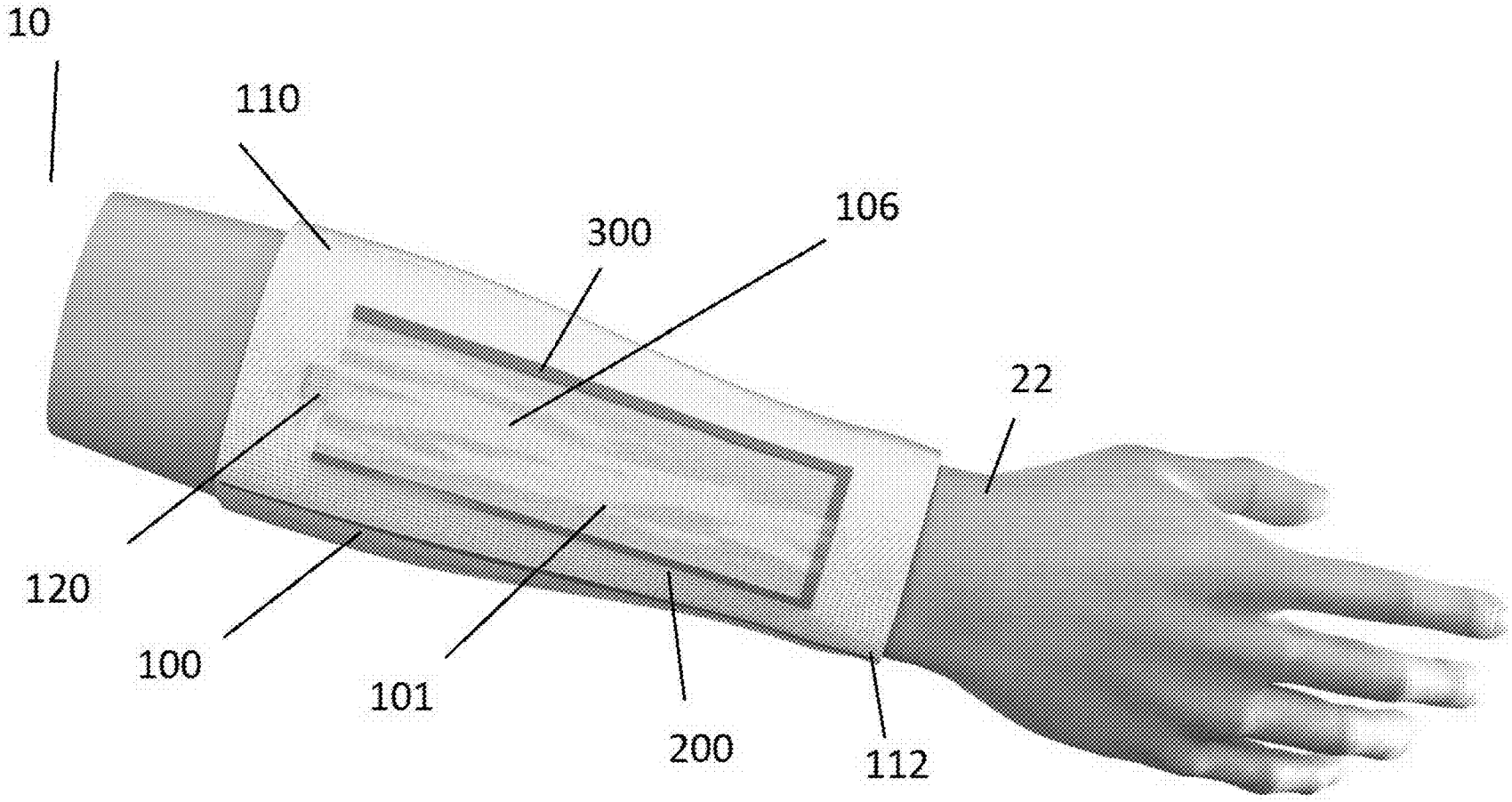
FIG. 1 is a high level drawing of a patient identification band according to an embodiment of the teachings herein with the tab in a closed position.

A better understanding of the disclosed technology will be obtained from the following detailed description of the preferred embodiments taken in conjunction with the drawings and the attached claims.

DETAILED DESCRIPTION OF EMBODIMENTS OF THE DISCLOSED TECHNOLOGY

Embodiments of the disclosed technology comprise a patient identification device for identifying a patient while maintaining the patient's privacy, and method of use of the identification device. The device is configured to be worn by a patient, and includes private information of the patient which is concealed and public information which is readily accessible by observers of the device. The patient band is used inside or outside a hospital or clinic. While a patient at a hospital or clinic or while at home or outside the home when there is a need for the patient's information to be available in case of an emergency.

Referring now to the drawings, which represent a patient band including a visible portion for public patient information and a concealed portion for more private patient information, the description of same is as follows.

Figure 2:
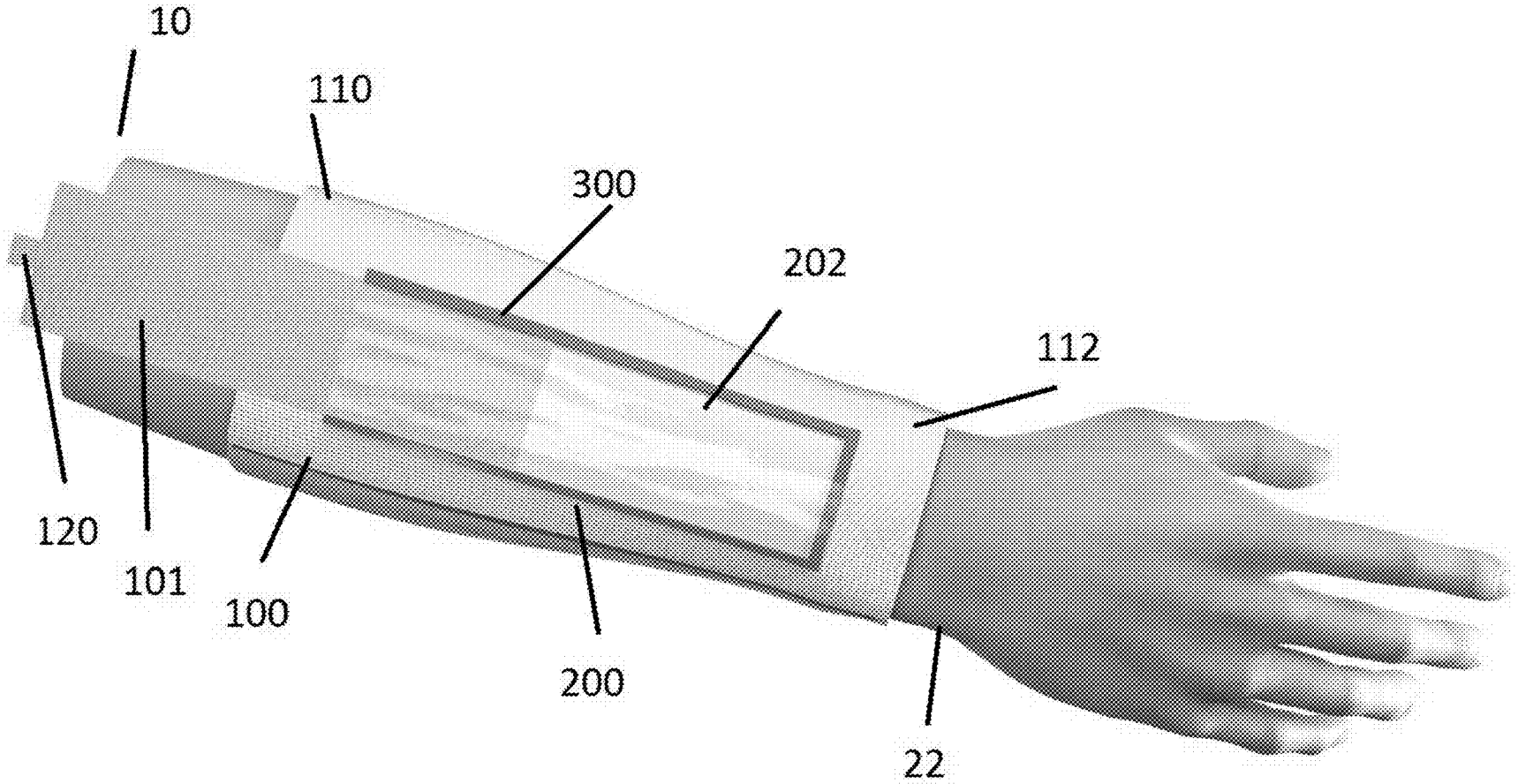
FIG. 2 is a high level drawing of the patient identification band of FIG. 1 with the tab open.

FIGS. 1 and 2 show a high level drawing of a patient identification band 100 according to an embodiment of the teachings herein, in a first visibility orientation. As seen, the patient identification band 100 is placed on a user's hand, substantially between two joints. In the illustrated embodiment, the upper extremity 110 of the band 100 is located substantially at the elbow 10 and the lower extremity 112 of band 100 is located substantially at the wrist 22. Though the patient band 100 is illustrated as placed on the patient's arm, it is appreciated that the band 100 may be placed in any suitable location on the patient's body, such as on the patient's upper arm substantially between the armpit and the elbow, or on the patient's leg substantially between the knee and the ankle. Placement of the band 100 on body portions other than the wrist or arm are particularly advantageous when in patients for whom the band cannot be placed on the arm or wrist, such as amputees or patients suffering from severe burns.

In the context of the present application, the phrase "substantially between two joints" or "substantially between a first joint and a second joint" refers to the band being placed between two anatomical joints located between bones, and spanning most of the area between the two anatomical joints, such that the band does not cover at most four inches of the area between the two joints, at most two inches of the area between the two joints, or at most one inch of the area between the two joints.

The band 100 may be formed of any suitable material, such as plastic, woven fabric, knitted fabric, and the like, and in some embodiments is formed of a "breathing" material which allows exchange of air between the skin below the band 100 and the ambient environment and prevents sweating and discomfort from being caused by the band 100.

The band 100 is typically secured on the patient's body using suitable securing means (not shown), such as Velcro®, hook and loop fasteners, buttons, button fasteners, buckles, and the like. In some embodiments, the band 100 is irremovably secured on the patient's body, such that the band 100 can only be removed from the patient by destroying the band. In other embodiments, the band 100 is removably secured, such that the patient or a caregiver may occasionally temporarily remove the band, for example when taking a shower.

The patient identification band 100 includes a band portion 200 which surrounds the patient's arm, and a tab 101, which is attached to the band portion 200. The tab 101 may be connected to band tab location 200 using tab edge slots 300. The tab edge slot 300 are slighting raised from the body of the band 100. Enough so that the tab 101 can slide into. The tab edge slot 300 is slightly larger than the tab 101. The tab 101 has a pull tab 120 that extends out from the outside edge of the tab 101 so that a user can easily grab the tab 101 to pull it out.

Band portion 200 includes one or more band information display portions 202, positioned such that the information displayed therein is concealed by tab 101 when the tab is connected to band portion 200 using the tab edge slot 300.

The tab 101 can include one or more outer tab information display portions which are located on the outer surface of tab 101 and are easily visible when the tab 101 is connected to band portion 200. The tab 101 can be removable and replaceable so a unique tab 101 can be used for each patient.

It is a particular feature of the present invention that private information about the patient, or information which the patient wants to keep private, is displayed in the band information display portion 202 which may be concealed from passersby and hospital employees who need not know the personal information by closing the tab 101.

In the context of the present application, the terms "private information" and "more private information" refer to any information which identifies the patient, such as information that could enable a passerby to steal the patient's identity, or to any information which relates to the specific treatment required by the patient, such that placement of that information on a visible place would be a breach of patient confidentiality legislation, such as the U.S. Health Insurance Portability and Accountability Act of 1996, known as HIPAA. In the disclosure herein, the terms "private information" and "more private information" are used interchangeably and are considered fully equivalent to one another.

In some embodiments, the private patient information includes demographic information of the patient, such as the patient's name illustrated in information display portion on the tab 101 and the patient's date of birth illustrated in the tab display portion. In some embodiments the private demographic information may also include the patient's address, identification number such as a passport number or social security number, the contact information for a caregiver of the patient (particularly when the patient is a child or is incapable of caring for themselves), and any other suitable demographic information. In some embodiments the private patient information includes patient treatment information, such as the patient's medical record number illustrated in information display portion, the name and/or contact information of the patient's attending physician illustrated in information display portion 202, and/or special care needs of the patient illustrated in information display portion 202. Special care needs of the patient may include any information regarding the patient's treatment of which the treating medical personnel must be aware, such as an indication of a fall risk, tendency to wander, dementia, depression, tendency to remove treatment devices such as tubes, a refusal to receive blood transfusions, a refusal to receive organ donations, and the like.

In the context of the present application, the terms "public information" and "more public information" refer to any information which does not uniquely identify the patient and may not cause damage to the patient if it is known by passersby, such as the patient's initials or hospital room number, and to medical or treatment information which may be required by non-medical personnel, for example to ensure the patient's safety. The terms "public information" and "more public information" may also refer to information not protected by patient confidentiality legislation such as HIPAA. In the disclosure herein, the terms "public information" and "more public information" are used interchangeably and are considered fully equivalent to one another.

In some embodiments, the more public patient information includes public demographic information such as the patient's initials as illustrated in tab information display portion 102. The more public information may also include medical and/or treatment information which may be required by non-medical personnel or by non-treating medical personnel. In some embodiments, the public patient information includes information regarding allergies from which the patient suffers as illustrated in information display portion 102, so as to ensure that the patient is not given food or medications which would trigger and allergic reaction and may endanger his or her life. In some embodiments, the public patient information includes code status, or instructions regarding the patient's treatment preferences, such as living will information, and a DNR (Do Not Resuscitate) and/or a DNI (Do Not Intubate) indication, illustrated in information display portion 102.

In some embodiments, the more public patient information also includes treatment information which may be required by nurses or paramedical personnel treating the patient. In some embodiments, the public patient information includes information about the current IV of the patient, illustrated in information display portion 102. The IV information may include the date of insertion of the current IV, an identification of the person who inserted the current IV, and/or the location of the current IV, and may be provided in readable format or in an encoded format. In some embodiments, the more public information also includes information to be used if the patient becomes lost, such as the patient's room number in the medical facility or a contact number for the patient's caregiver. This is particularly advantageous for patients who may not remember how to get back to their room in the medical facility, such as patients suffering from dementia or from Alzheimer's disease or children.

It is appreciated that any other suitable private information may be included in private information display portion 202, and that additional concealed information display portions may be included in patient band 100. Similarly, any other suitable information may be included in more public information display portions 102, and that additional visible information display portions may be included in patient band 100.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

The invention claimed is:

1. A patient identification unit comprising:

a cylindrical, conformable sleeve element configured to be worn by a patient such that it circumscribes about and extends along a substantial portion of a user's limb;

a linearly elongated containment sleeve supported by and aligned along a length of conformable sleeve element, said containment sleeve having a transparent outer window covering an inner band information display portion;

an insert removably retained within the containment sleeve where said insert is adapted to be placed to cover said inner band information display portion and where the insert further has an outer information display portion, wherein information provided in on the inner band information display portion can be selectively occluded from public view by said insert and information is provided on the outer information display portion remains available for public display.

2. The patient identification unit of claim 1, wherein said substantial portion of a user's limb comprises spanning a length of approximately one half or more of a distance between two adjacent joints of the limb.

3. The patient identification unit of claim 2, wherein said user's limb is selected from a group consisting of: the patient's biceps; the patient's forearm; and the patient's leg between the patient's knee and the patient's ankle.

4. The patient identification unit of claim 1, further comprising linearly extended lateral edge slots within said containment sleeve that are slighting raised from an upper to accommodate receiving and moving of said insert.

5. The patient identification unit of claim 1, further comprising connectors for removably retaining said insert over said sleeve element, said connectors capable of being detached in order to expose said inner band information display portion and, alternately, said connectors being affixed in order to occlude said inner band information display portion.

6. The patient identification unit of claim 1, wherein said insert has a graspable pull tab.

7. The patient identification unit of claim 1, wherein said information provided on the inner band information display portion comprises information required to be secured under patient confidentiality legislation.

8. The patient identification unit of claim 1, wherein information provided on the inner band information display portion comprises information of the patient, including at least one of a listing of the patient's attending physician, contact information for said attending physician, a medical record number for the patient, and information regarding the patient's special care needs.

9. The patient identification unit of claim 1, wherein information provided on said outer information display portion includes medical information for the patient, including at least one of a listing of patient allergies, living will information, Do Not Incubate (DAI) information for the patient, and Do Not Resuscitate (DAR) information for the patient.

10. The patient identification unit of claim 9, wherein information provided on said outer information display portion also includes at least one of the patient's initials, dale of insertion of a current IV, location of said current IV, identification of medical personnel who inserted said current IV, the patient's medical facility room number, and a stainable barked associated with the patient's private information and/or medical record.

11. The patient identification unit of claim 1, wherein at least one of said inner information display portion and said outer information display portion comprises multiple information display regions, each displaying a different type of information and/or a different information item.

12. A method for identifying a patient, comprising:

placing a wearable information containment device on a patient's body along a substantial length of and circumscribing an extremity;

providing a medical information on a lower surface within the containment device;

providing a occlusion mechanism that is selectively engageable within said containment device;

providing an identifying information on an outer surface of said occlusion mechanism that is displayable when said occlusion mechanism is engaged within said containment device; wherein said occlusion mechanism is adapted to display said medical information when disengaged from said containment device and to obfuscate said medical information when engaged with said containment device.

13. The method of claim 12, wherein said occlusion mechanism further comprises a graspable tab;

whereby display of said medical information may be access by pulling said tab, thereby disengaging said occlusion mechanism from said containment device and thereby exposing said medical information for display.

14. The method of claim 13, wherein said wearable information containment device is placed about an on a patient's arm, substantially between the patient's elbow to the patient's wrist.

15. The method of claim 13, wherein said wearable information containment device is placed on and about a patient's biceps, substantially between the patient's elbow to the patient's armpit.

16. The method of claim 13, wherein said wearable information containment device is placed on and about a patient's leg, substantially between the patient's knee and the patient's ankle.

17. The method of claim 12, wherein said wearable information containment device is placed about an on a patient's arm, substantially between the patient's elbow to the patient's wrist.

18. The method of claim 12, wherein said wearable information containment device is placed on and about a patient's biceps, substantially between the patient's elbow to the patient's armpit.

19. The method of claim 12, wherein said wearable information containment device is placed on and about a patient's biceps, substantially between the patient's elbow to the patient's armpit.

20. The method of claim 12, wherein said wearable information containment device is placed on and about a patient's leg, substantially between the patient's knee and the patient's ankle.

* * * * *